US008297918B2

(12) United States Patent
Bhatnagar

(10) Patent No.: US 8,297,918 B2
(45) Date of Patent: Oct. 30, 2012

(54) VARIABLE POSITION GUIDE VANE ACTUATION SYSTEM AND METHOD

(75) Inventor: Shubhra Bhatnagar, Karnataka (IN)

(73) Assignee: General Electric Company, Schenectady, NY (US)

( * ) Notice: Subject to any disclaimer, the term of this patent is extended or adjusted under 35 U.S.C. 154(b) by 666 days.

(21) Appl. No.: 12/349,160

(22) Filed: Jan. 6, 2009

(65) Prior Publication Data

US 2010/0172744 A1 Jul. 8, 2010

(51) Int. Cl.
*F01D 17/16* (2006.01)

(52) U.S. Cl. ..... 415/160; 415/162; 415/208.2

(58) Field of Classification Search ..... 415/157, 415/159–164, 149.4, 208.1, 208.2
See application file for complete search history.

(56) References Cited

U.S. PATENT DOCUMENTS

| | | | | |
|---|---|---|---|---|
| 3,508,839 | A * | 4/1970 | Strub | 415/149.4 |
| 3,861,822 | A * | 1/1975 | Wanger | 415/147 |
| 4,558,986 | A * | 12/1985 | Faltys | 415/150 |
| 4,867,635 | A | 9/1989 | Tubbs | |
| 4,978,280 | A * | 12/1990 | Tubbs | 415/159 |
| 5,314,301 | A * | 5/1994 | Knight | 415/160 |
| 6,106,227 | A * | 8/2000 | Honda et al. | 415/145 |
| 2005/0252210 | A1* | 11/2005 | Shiraishi et al. | 60/602 |
| 2009/0226305 | A1* | 9/2009 | Wong et al. | 415/160 |

FOREIGN PATENT DOCUMENTS

JP 58059400 A 4/1983

OTHER PUBLICATIONS

EP 09179376.0, European Search Report and Written Opinion, Dec. 14, 2010.

Bhatnagar, Shubhra . "Variable Position Guide Vane Actuation System and Method," U.S. Appl. No. 12/349,107, filed Jan. 6, 2009. Specification having 7 pages, Figures having 4 sheets.

* cited by examiner

*Primary Examiner* — Fernando L Toledo
*Assistant Examiner* — Victoria K Hall
(74) *Attorney, Agent, or Firm* — Cantor Colburn LLP

(57) ABSTRACT

Disclosed herein is a turbine variable position guide vane actuation system. The system includes, a plurality of variable position guide vanes, a plurality of actuators with each actuator in operable communication with one of the plurality of variable position guide vanes, and each of the plurality of actuators having a pin. The system further having at least one structure, movable parallel to an axis of the turbine, having a plurality of slots and each of the plurality of slots is in operable communication with one of the pins.

5 Claims, 4 Drawing Sheets

VARIABLE POSITION GUIDE VANE ACTUATION SYSTEM AND METHOD

BACKGROUND OF THE INVENTION

The disclosed invention relates to a system for actuating variable position guide vanes in a turbine engine. More specifically the invention relates to actuating the variable position guide vanes by moving a structure in operable communication with a plurality of the variable position guide vanes.

Aerodynamic efficiency of the vanes of a turbine engine is an important factor in the overall operational efficiency of the engine. Operators rotate the vanes in an attempt to improve the aerodynamic performance at different power settings of the turbine. Systems and methods to improve precision and control of rotation of the multitude of vanes in a turbine engine is of value to operators in the industry.

BRIEF DESCRIPTION OF THE INVENTION

Disclosed herein is a turbine variable position guide vane actuation system. The system includes, a plurality of variable position guide vanes, a plurality of actuators with each actuator in operable communication with one of the plurality of variable position guide vanes, and each of the plurality of actuators having a pin. The system further having at least one structure, movable parallel to an axis of the turbine, having a plurality of slots and each of the plurality of slots is in operable communication with one of the pins.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Turbine engines, such as, gas turbine engines for power generation, for example, have stationary guide vanes and rotating guide vanes. Compressed air flows past both types of guide vanes during operation of the turbine. Performance of the turbine can vary depending upon, among other things, angles of the stationary guide vanes. During different operating conditions, however, different guide vane angles may be preferred. As such, having guide vanes, wherein angles of the vanes are variable, has benefits to the turbine operator. Systems and methods for adjusting the variable guide vanes are described in detail below.

Figure 1:
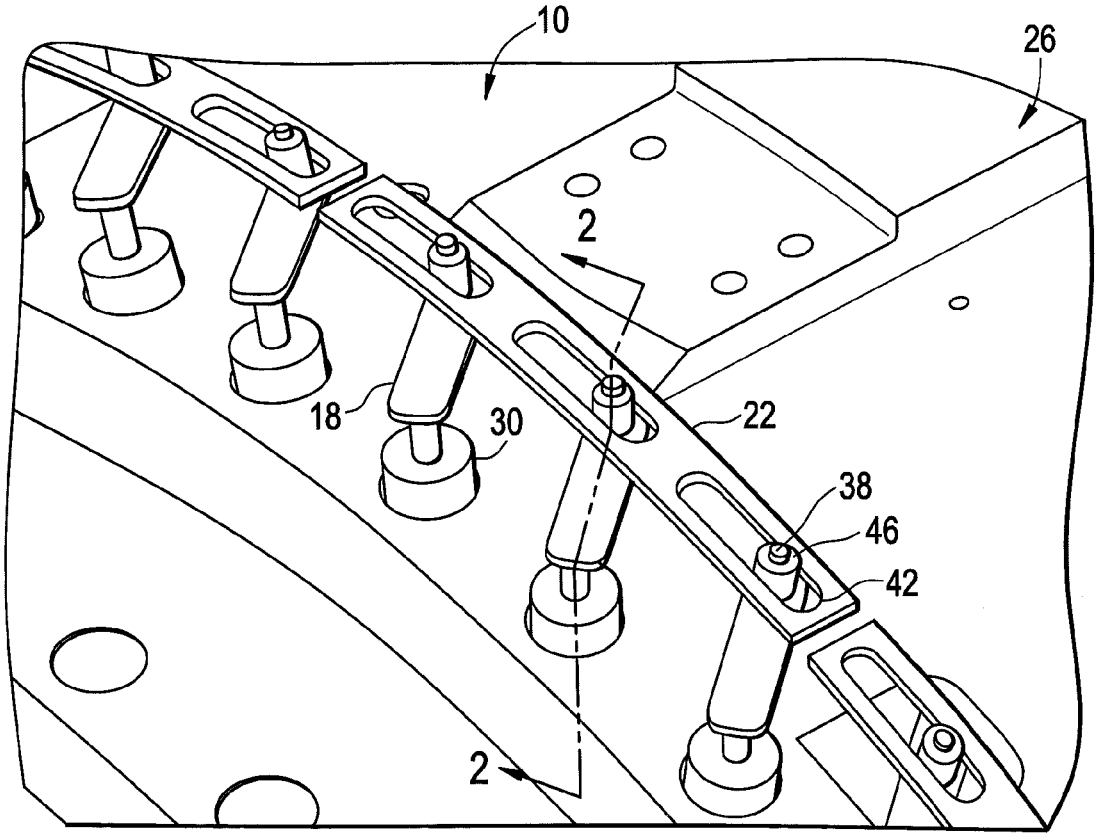
FIG. 1 depicts a partial perspective view of a turbine variable position guide vane actuation system disclosed herein.

Referring to FIG. 1, an embodiment of a turbine variable position guide vane actuation system 10 disclosed herein is illustrated. The system 10 includes, a plurality of variable position guide vanes 14 with an actuator 18, shown herein as a lever, attached to each one of the variable position guide vanes 14, and at least one structure 22, shown herein as a plate, engaged with a plurality of the levers 18. The plate 22 is configured to be moved in a direction parallel to an axis of the turbine 26 to cause rotational motion of each of the levers 18, engaged therewith, and consequently to rotate the variable position guide vanes 14 attached thereto.

Figure 2:
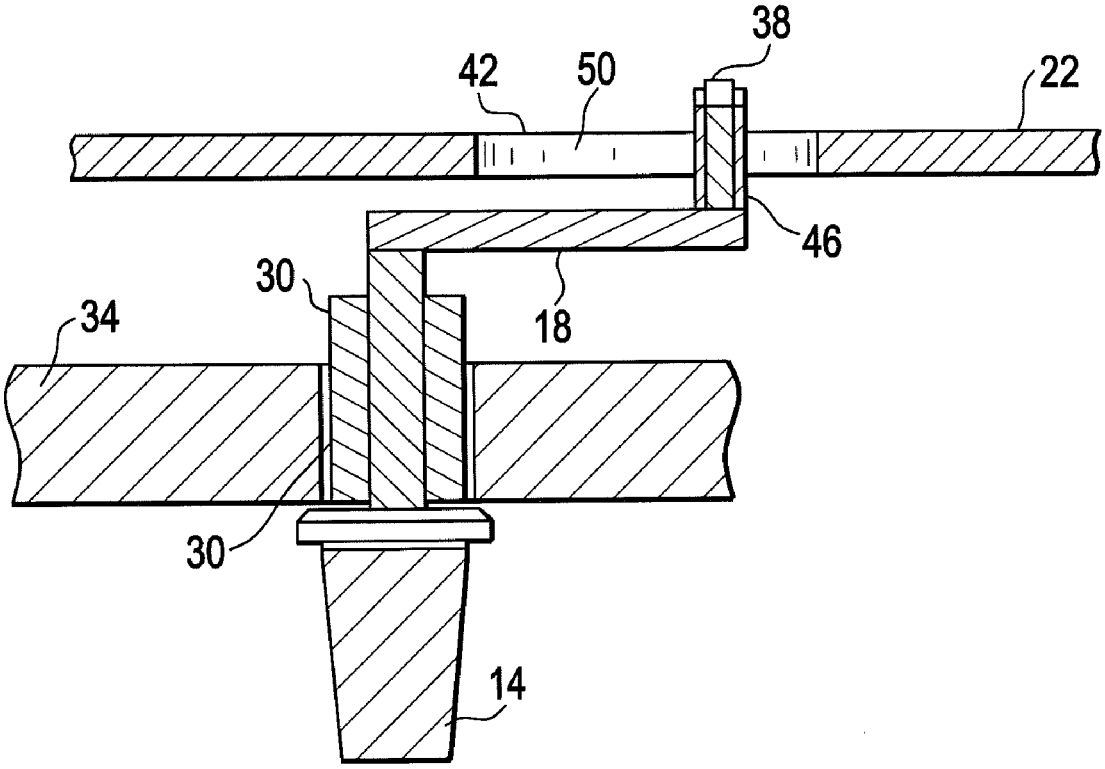
FIG. 2 depicts a cross sectional view of a portion of the turbine variable position guide vane actuation system of FIG. 1 taken along arrows 2-2.

Referring to FIG. 2, a cross sectional view through one of the variable position guide vanes 14, the lever 18 and the plate 22, of FIG. 1, along arrows 2-2, is shown. A bushing or bearing 30 rotationally, mounts each of the variable position guide vanes 14 to a casing 34 of the turbine 26. A pin 38 extends from each of the levers 18 to engage with a slot 42 of the plate 22. Optionally, a sleeve 46 can be rotationally engaged with each of the pins 38 to reduce frictional engagement between the pins 38 and walls 50 of the slots 42.

By moving the plates 22 parallel to an axis of the turbine 26 the lateral or radial instability (as the case may be) that occurs in typical systems that have the plate 22 move circumferentially with respect to the turbine 26 can be reduced. In addition to decreasing friction between the sleeve 46 and the plate 22, in comparison to typical systems, embodiments disclosed herein can more easily control the precision of the rotational motion of the variable position guide vanes 14. This ease of control is due to a reduced offset between the linear motion of the plate 22 and the rotational motion of the variable position guide vanes 14, as compared to a circumferential motion of a plate. This control precision can be maintained in alternate embodiments as will be described below.

Figure 3:
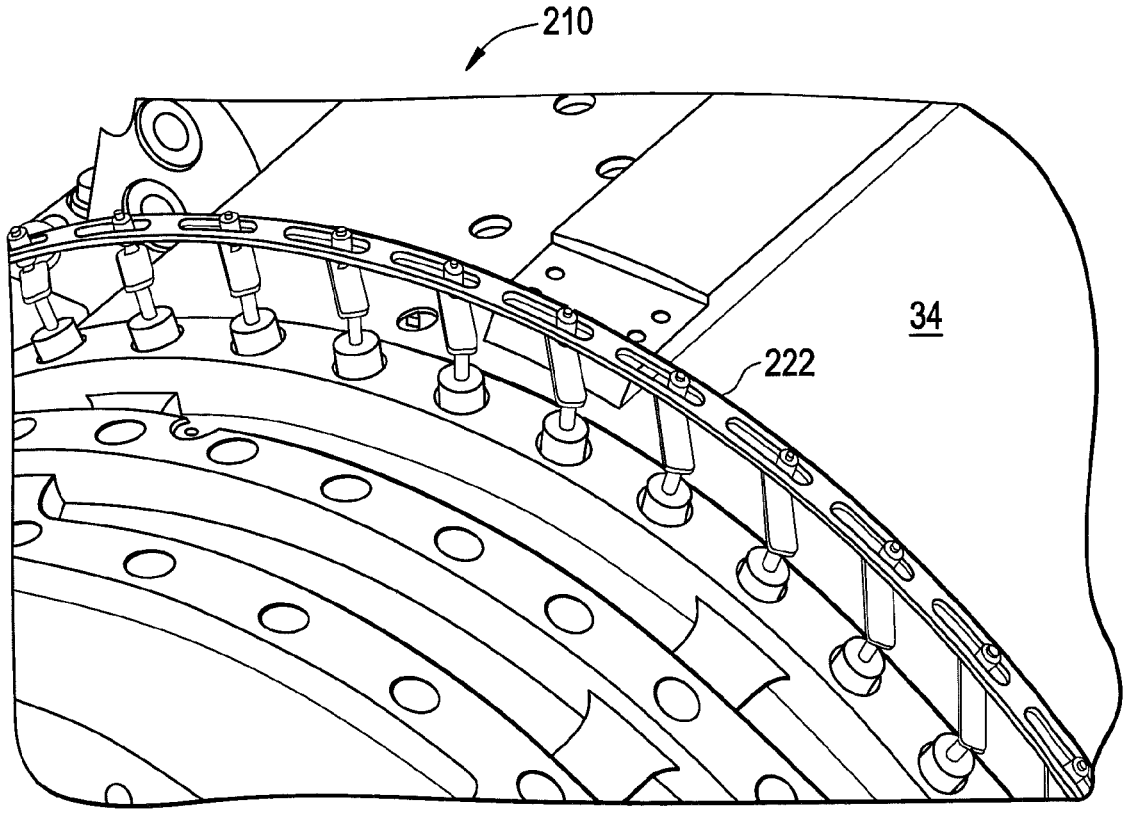
FIG. 3 depicts a partial perspective view of an alternate variable position guide vane actuation system disclosed herein.

Referring to FIG. 3, an alternate embodiment of a turbine variable position guide vane actuation system 210 with a plate 222 disclosed herein is illustrated. Unlike the plates 22 shown above that each functionally engage with few of the levers 18, the plate 222 forms a ring perimetrically around a significant portion of the turbine 26. In fact, the plate 222 can be a continuous ring that encircles the casing 34 and actuates all of the levers 18, or be segmented to actuate any selected number of the levers 18 desired. For assembly and removal purposes splitting the plate 222 into at least two portions, with each encircling approximately half of the casing 34, may be advantageous.

Figure 4:
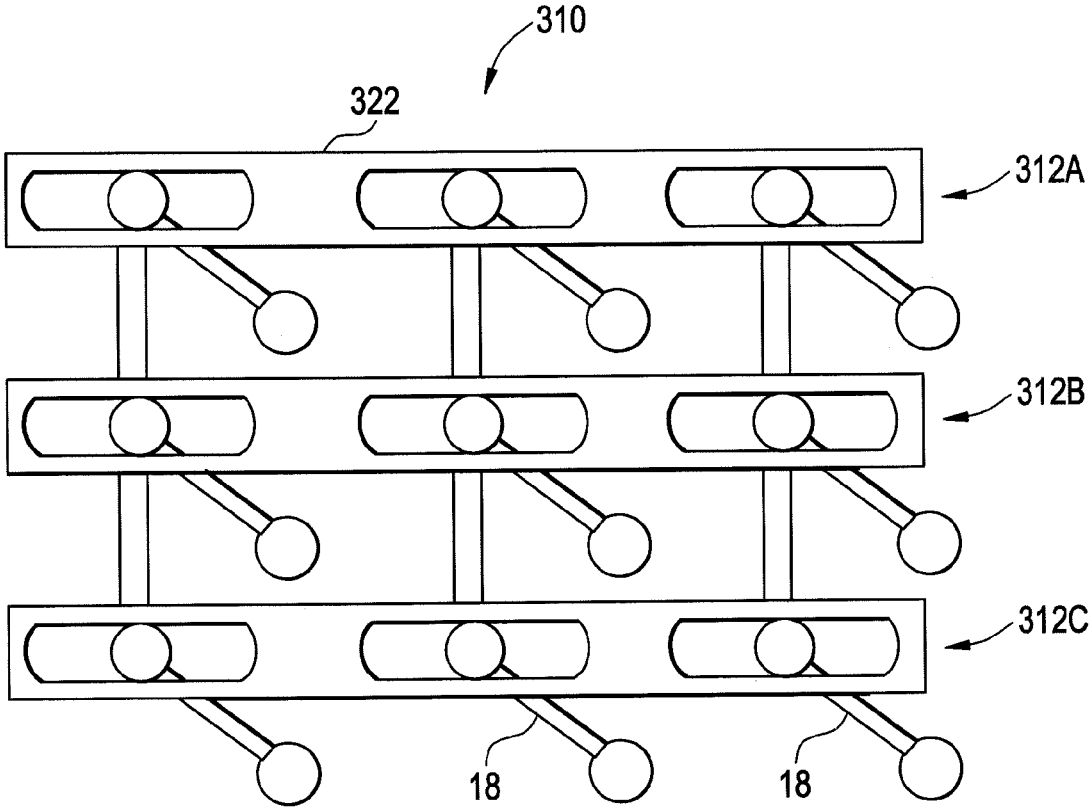
FIG. 4 depicts a partial perspective view of another alternate variable position guide vane actuation system disclosed herein.

Referring to FIG. 4, yet another alternate embodiment of a turbine variable position guide vane actuation system 310 with plates 322 disclosed herein is illustrated. The plates 322 are a variation of the structures 22. The plates 322 are configured to actuate levers 18 on multiple stages simultaneously. The plates 322 actuate variable position guide vanes 14 from different stages 312A, 312B and 312C of the turbine 26. Such a "ganged" system can significantly simplify the linkages required to actuate a multitude of the variable position guide vanes 14 at once. Two or more stages can be "ganged" together forming one or more "gangs," for example. This variation of the "ganged" system can also be used for the plates 222.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A turbine variable position guide vane actuation system, comprising:

a plurality of variable position guide vanes;

a plurality of actuators with each actuator being in operable communication with one of the plurality of variable position guide vanes, and each of the plurality of actuators having a pin, wherein at least one of the pins has a sleeve mounted thereto, the sleeve rotationally free to move about the at least one pin; and at least one structure being movable in a relatively axial direction and parallel to an axis of the turbine, the at least one structure having a plurality of slots extending fully through the at least one structure, each of the plurality of slots surrounding one of the pins, wherein the at least one structure comprises a plurality of operably coupled plates, wherein the plurality of actuators are in operable communication with variable position guide vanes from more than one stage of the turbine.

2. The turbine variable position guide vane actuation system of claim 1, wherein the at least one structure is arcuate shaped and is substantially concentric with a casing of the turbine.

3. The turbine variable position guide vane actuation system of claim 1, wherein movement of the at least one structure in a direction parallel to an axis of the turbine causes rotation of each of the actuators in operable communication therewith.

4. The turbine variable position guide vane actuation system of claim 3, wherein rotation of each of the actuators causes rotation of one of the variable position guide vanes in operable communication therewith.

5. The turbine variable position guide vane actuation system of claim 1, wherein the plurality of actuators are a plurality of levers.

* * * * *